US011198527B2

(12) United States Patent
Burnette

(10) Patent No.: US 11,198,527 B2
(45) Date of Patent: Dec. 14, 2021

(54) CUSTOM PACKAGING PROCESS AND EQUIPMENT FOR STRETCH WRAPPING EASELS

(71) Applicant: Syndicate Sales, Inc., Kokomo, IN (US)

(72) Inventor: Troy L. Burnette, Greentown, IN (US)

(73) Assignee: Syndicate Sales, Inc., Kokomo, IN (US)

( * ) Notice: Subject to any disclaimer, the term of this patent is extended or adjusted under 35 U.S.C. 154(b) by 140 days.

(21) Appl. No.: 16/284,464

(22) Filed: Feb. 25, 2019

(65) Prior Publication Data

US 2020/0270005 A1 Aug. 27, 2020

(51) Int. Cl.

| | |
|---|---|
| ***B65B 11/00*** | (2006.01) |
| ***B65B 11/04*** | (2006.01) |
| ***B65B 9/067*** | (2012.01) |
| ***A47B 97/04*** | (2006.01) |
| ***B65B 35/50*** | (2006.01) |

(52) U.S. Cl.

CPC ..... *B65B 11/045* (2013.01); *A47B 97/04* (2013.01); *B65B 9/067* (2013.01); *B65B 35/50* (2013.01)

(58) Field of Classification Search

CPC ..... B65B 11/00; B65B 11/02; B65B 11/04; B65B 11/045; A47B 97/04; A47B 97/08

USPC ..... 53/556

See application file for complete search history.

(56) References Cited

U.S. PATENT DOCUMENTS

| | | | | |
|---|---|---|---|---|
| 5,546,730 | A * | 8/1996 | Newell | B65B 11/585 53/139.7 |
| 5,566,530 | A * | 10/1996 | Johnstone | B65B 11/045 53/441 |
| 7,374,144 | B1 * | 5/2008 | Wonderling | A47B 97/08 248/441.1 |
| 7,536,840 | B2 * | 5/2009 | Ours | B65D 71/0088 53/173 |
| 8,074,431 | B1 | 12/2011 | Pierson et al. | |
| 8,191,341 | B2 * | 6/2012 | Ours | B65B 11/045 53/399 |

OTHER PUBLICATIONS

Customized Stretch Wrapping Machine For Window, Stretch Wrappers by Phoenix, Published on Dec. 21, 2011, available at https://www.youtube.com/watch?v=u6Ya-E--oEY&feature=youtu.be.

* cited by examiner

*Primary Examiner* — Chelsea E Stinson

(74) *Attorney, Agent, or Firm* — Woodard, Emhardt, Henry, Reeves & Wagner, LLP

(57) ABSTRACT

A method of packaging easel includes attaching an easel packaging fixture to a rotatable turntable of a stretch wrapping apparatus that includes a tower and a carriage movable along the tower. An easel bundle is positioned on the easel packaging fixture. Each easel bundle includes one or more easels with a lower portion inserted into a bottom cap and an upper portion inserted into a top cap. The turntable is rotated, causing rotation of the easel packaging fixture and the easel bundle with respect to the stretch wrapping apparatus. As the easel packaging fixture rotates, a wrapping material from the carriage of the stretch wrapping apparatus wraps around the easel bundle. The carriage moves along the length of the tower to wrap a length of the easel bundle.

14 Claims, 7 Drawing Sheets

CUSTOM PACKAGING PROCESS AND EQUIPMENT FOR STRETCH WRAPPING EASELS

BACKGROUND

Easels are commonly used by artists, florists, designers and the like every day. Artists use them to hold paintings and other works of art during their creation and for subsequent display. Florists use easels to display various floral arrangements, including wreaths, standing sprays and the like. Oftentimes easels are utilized for supporting floral arrangements at weddings, outdoor parties, formal events, funerals, memorial services and the like. As a result, to the demand for easels remains strong.

Despite the strong demand for easels, the shipment of easels from a manufacturer to a buyer or a distributor presents several issues. Typically, a number of easels are shipped from a manufacturer as a group where some of the easels in the group are rotated 180 degrees with respect to the other easels to form a rectangular shape that fits inside a standard shipping box. These easels are necessarily large in size in order to be capable of supporting items of a variety of different sizes and to place the supported item at the proper level with respect to the intended audience. The large size of the easels makes the resulting packaging cumbersome and difficult for just one person to carry. Additionally, the relatively sharp edges which are often present on of the top of the easels and on the bottom of the legs are prone to tearing through and damaging the shipping container, which often results in damage to the easel itself.

Thus, there is a need for improvement in this field.

SUMMARY

Certain embodiments include a method of packaging a plurality of easels for shipment. In one form, the method includes attaching an easel packaging fixture to a turntable of a stretch wrapping apparatus. The stretch wrapping apparatus includes a tower and a carriage movable vertically along at least a portion of the tower. An easel bundle is positioned on the easel packaging fixture. The easel bundle includes one or more easels. A lower portion of each of the easels is inserted into a bottom cap, and an upper portion of each of the easels is inserted into a top cap.

Once the easel bundle, bottom cap and top cap are in place, the turntable is rotated so that the easel packaging fixture and the easel bundle, bottom cap and top cap mounted therein rotate with respect to the tower and the carriage of the stretch wrapping apparatus. As the turntable rotates the easel bundle a wrapping material, such as stretch wrap, from the carriage wraps around the easel bundle. The carriage moves along a length of the tower as the easel bundle rotates to wrap a length of the easel bundle covering its lower portion and its upper portion with the wrapping material.

In some embodiments, the easel bundle comprises a plurality of easels arranged in the same orientation, a bottom cap, top cap. The easel including a plurality of legs that meet at a common joint at an upper portion of the easel. The legs diverge from the common joint to a lower portion of the easel.

The bottom cap includes a number of bottom cap side walls extending from a bottom cap base. A bottom cap recess is defined by the bottom cap side walls and base. The lower portion of the easel is configured to fit within the bottom cap recess The top cap includes a number of top cap sidewalls and a top cap base which collectively define a top cap recess. The common joints of the plurality of easels are configured to fit within the top cap recess. The wrapping material is then wrapped around at least a portion of the plurality of easels. The wrapping material may also be wrapped around the top cap and/or bottom cap.

Further forms, objects, features, aspects, benefits, advantages, and embodiments of the present invention will become apparent from a detailed description and drawings provided herewith.

BRIEF DESCRIPTION OF THE DRAWINGS

FIG. 6 is a front view of an easel of an easel bundle of the packaging system shown in

FIG. 1.

DESCRIPTION OF THE SELECTED EMBODIMENTS

Figure 1:
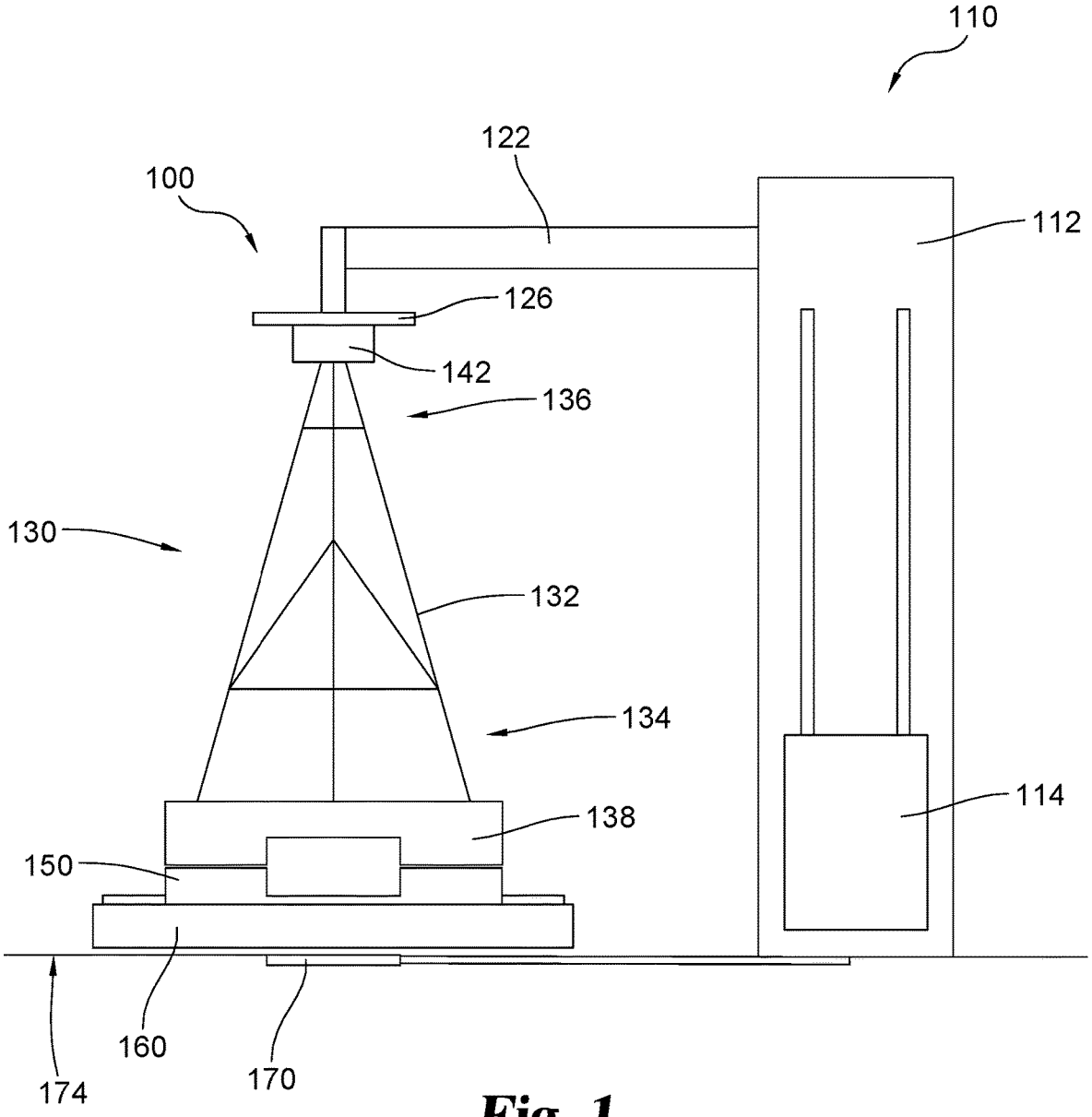
FIG. 1 is a front elevational view of a packaging system including an easel bundle and a stretch wrapping apparatus.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail; although it will be apparent to those skilled in the relevant art that some features that are not relevant to the present invention may not be shown for the sake of clarity.

FIG. 1 illustrates an embodiment of an easel packaging system 100. Easel packaging system 100 includes a stretch wrapping apparatus 110. It shall be appreciated that stretch wrapping apparatus 110 may take a variety of forms, but that the most popular turntable style machine is illustrated and described herein. In the illustrated form, stretch wrapping apparatus 110 includes a tower 112 and a carriage 114 that is vertically movable along at least a portion of the height of tower 112. An arm 122 extends from tower 112 and a platen 126 extends from an end of arm 122. An easel bundle 130, including one or more easels 132 oriented to form a triangular or "A" shaped arrangement, may be positioned beneath platen 126. A lower portion 134 of easel 132 is fit into a bottom cap 138 and an upper portion 136 of easel 132 is fit into a top cap 142. The position of platen 126 can be adjusted so that platen 126 is in contact with top cap 142 to provide support to easel 132. Each of the easels 132 in easel bundle 130 is oriented in the same direction so that the lower portion 134 of each easel 132 is aligned with the lower portions 134 of the other easels 132 and so that the upper portion 136 of each easel 132 is aligned with the lower portions 134 of the other easels 132.

Bottom cap 138 is positioned on an easel packaging fixture 150. The easel packaging fixture 150 is removably attached to turntable 160 that is secured to a pulley 170 that is part of the stretch wrapping apparatus 110. The pulley 170 may be hidden beneath a support surface 174, such as a deck or any other form of flooring. However, in some embodiments, pulley 170 may be positioned above support surface 174. The turntable 160 is configured to rotate upon operation of the pulley 170, causing rotation of the attached easel packaging fixture 150, and in turn, rotation of the bottom cap 138 and the easel bundle 130, including easel 132.

Figure 2:
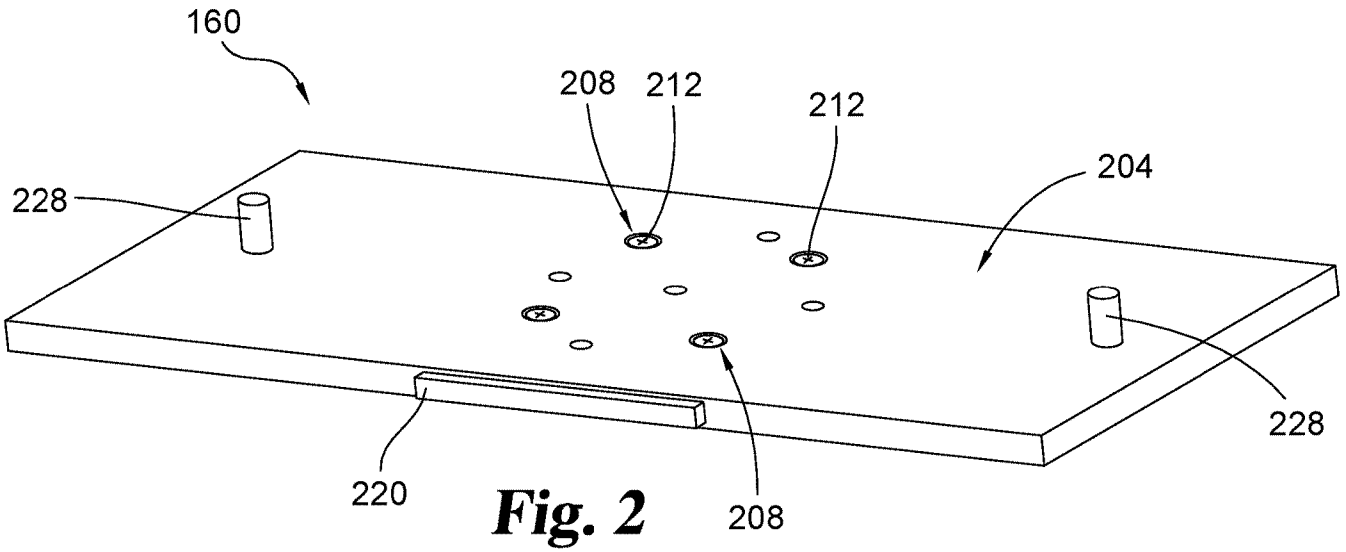
FIG. 2 is a top perspective view of a turntable of the packaging system shown in FIG. 1.

A top perspective view of turntable 160 is shown in FIG. 2. Turntable 160 includes a turntable base 204, which may be of any number of shapes, depending upon the stretch wrapping apparatus 110 selected. Turntable connection openings 208 are defined through turntable base 204. In the embodiment shown in FIG. 2, there are four turntable connection openings 208; however, other embodiments may include more or fewer turntable connection openings 208. Turntable connection openings 208 are configured to receive attachment members 212 that secure turntable 160 to pulley 170 at a pulley connection plate 220. As an example, attachment members 212 may be screws that are threaded into openings in pulley connection plate 220. In other embodiments, attachment members 212 may use any other suitable attachment method to attach turntable 160 to pulley 170. Fixture attachment posts 228 extend from turntable base 204 and provide an attachment point for easel packaging fixture 150 to be attached to turntable 160.

Figure 3:
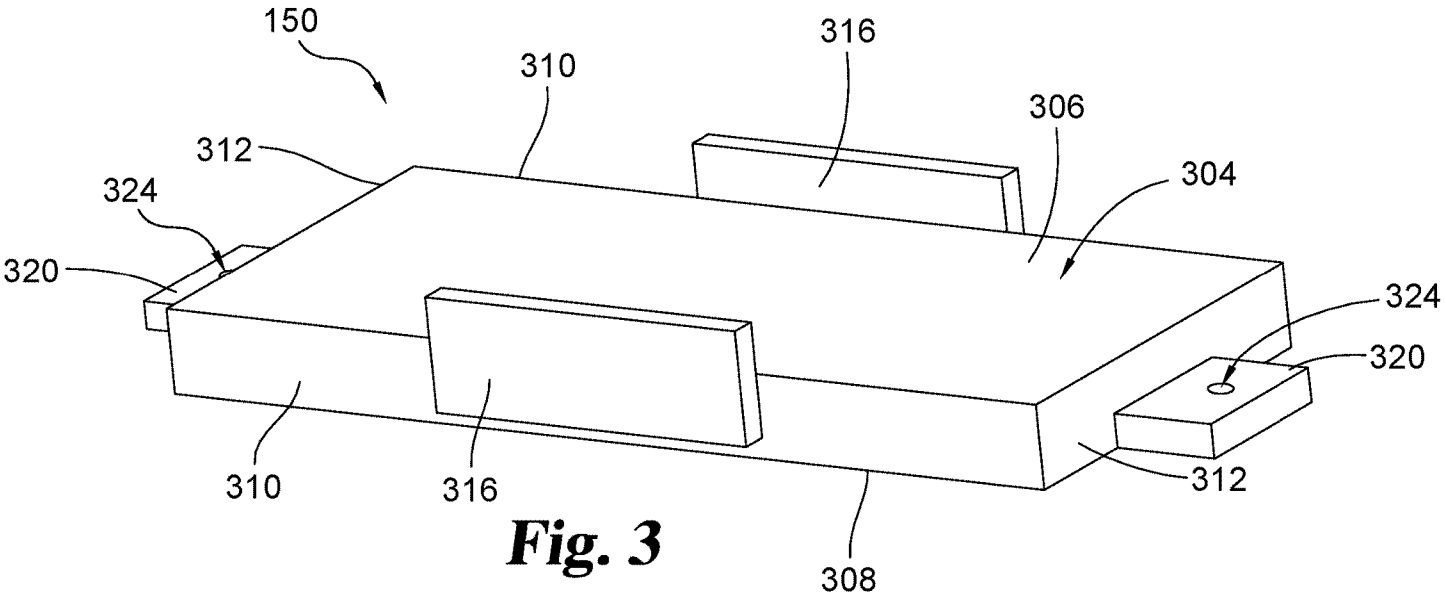
FIG. 3 is a top perspective view of an easel packaging fixture of the packaging system shown in FIG. 1.

FIG. 3 illustrates a perspective view of easel packaging fixture 150. Easel packaging fixture 150 includes a fixture base 304. In the illustrated form, fixture base 304 has a top face 306 and a bottom face 308 and includes opposing longitudinal edges 310 and opposing side edges 312 to form a rectangular shape. Although easel packaging fixture 150 is shown to be rectangular in FIG. 3, in other embodiments, easel packaging fixture 150 may be a different shape and/or size to fit the type of packaging desired for the easel 132 that are being packaged.

Fixture base 304 is sized to support and secure the bottom cap 138 which holds the lower portion 134 of easel 132. Vertical support flanges 316 are attached to fixture base 304 at opposing side edges 312 and project from the top face 306 of fixture base 304 to provide further support for and retention of a bottom cap 138 that is placed on easel packaging fixture 150. Attachment flanges 320 extend outward from the bottom face 308 of fixture base 304 at each side edge 312 to provide an attachment point to turntable 160. In one form, bottom face 308 may not exist and fixture base 304 may be in the form of a hollow box type structure. In this or other forms, the bottom face 308 may be formed from or may be in contact with a solid strip of aluminum or some other material which forms both flanges attachment 320. An attachment opening 324 is defined through each attachment flange 320.

Figure 4:
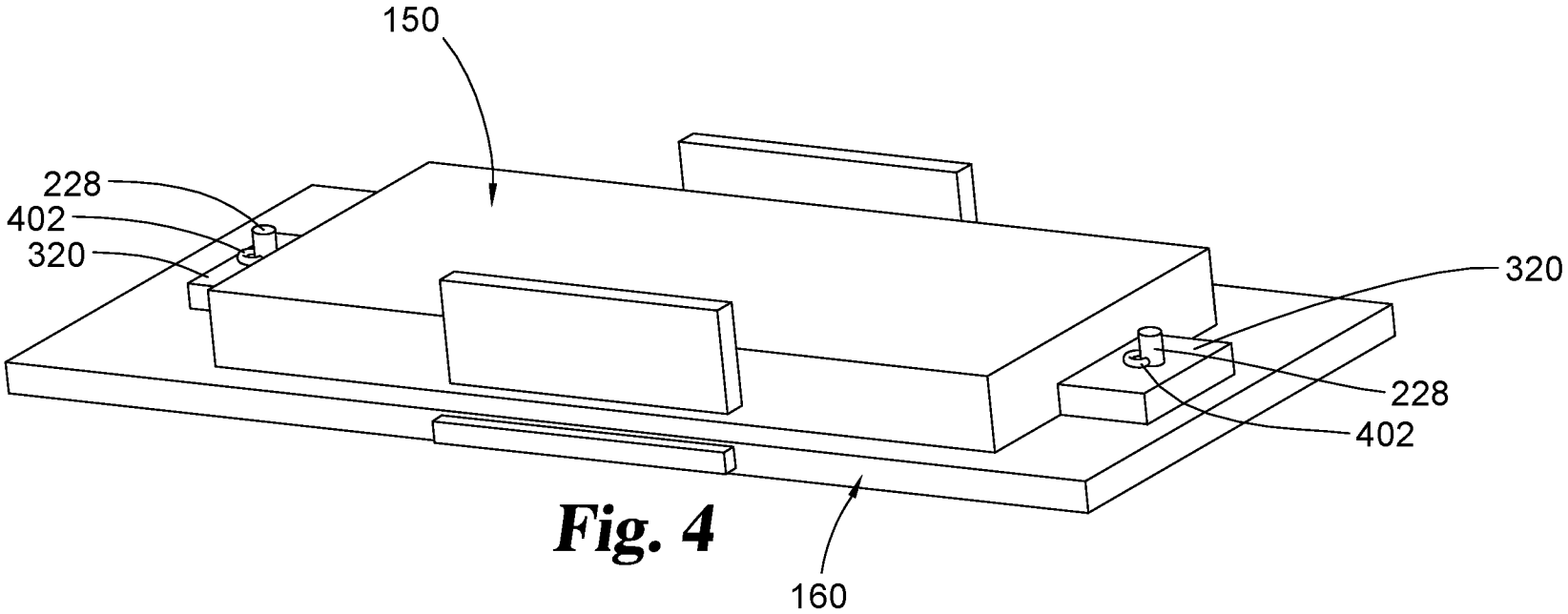
FIG. 4 is a top perspective view of the easel packaging fixture of FIG. 3 attached to the turntable of FIG. 2.

As shown in FIG. 4, easel packaging fixture 150 may be removably attached to turntable 160 by mating attachment openings 324 with fixture attachment posts 228, so that fixture attachment posts 228 fit through attachment openings 324 when easel packaging fixture 150 is positioned on turntable 160. In some embodiments, fixture attachment posts 228 may be further prevented from being inadvertently removed from attachment openings 324 by inserting a cotter pin 402 through an opening through fixture attachment post 228. In other embodiments, other suitable attachment mechanisms for preventing fixture attachment posts 228 from being removed from attachment openings 324 may be used.

Figure 5:
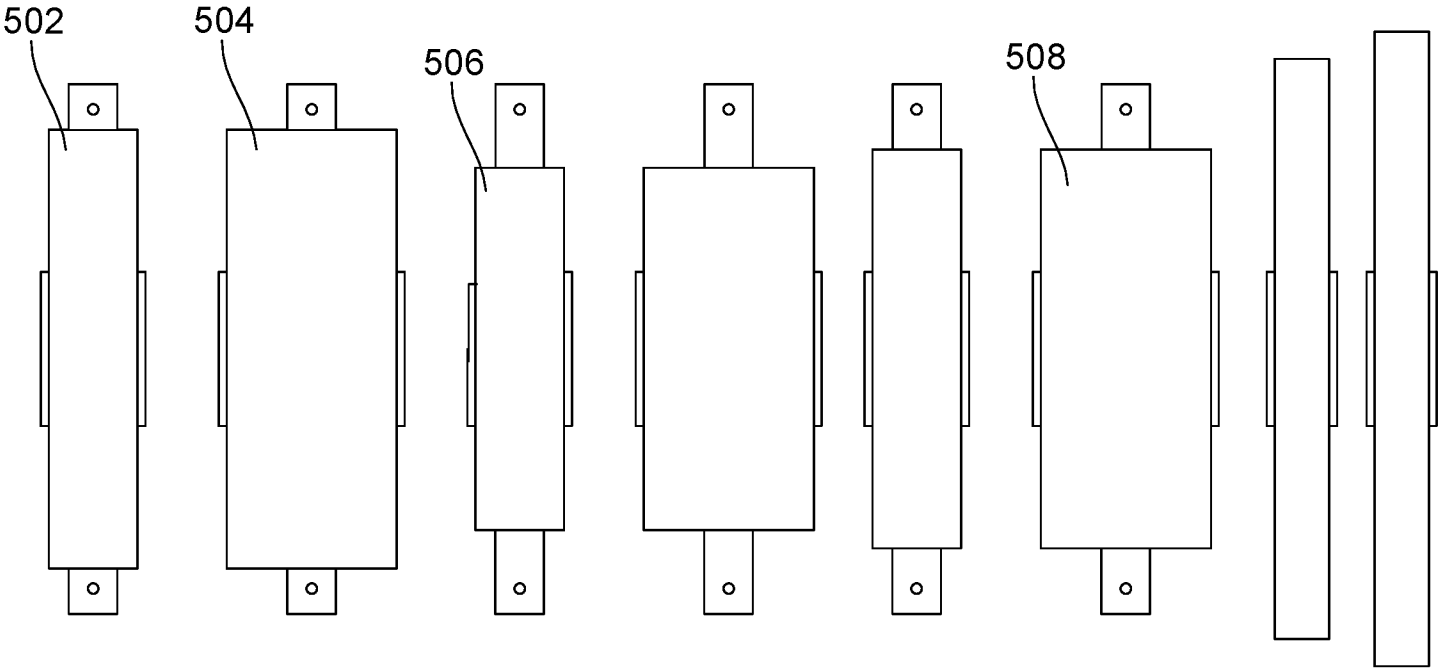
FIG. 5 is a collection of different sized easel packaging fixture s for attachment to the turntable of FIG. 2.

As illustrated in FIG. 5, the removable attachment between easel packaging fixture 150 and turntable 160 allows different size easel packaging fixtures 150 to be affixed to turntable 160 in order to fit easel assemblies 130 of varying widths, lengths, and sizes. As an example, fixture 502 is sized for a package including ten 60 inch easels. Fixture 504 is also sized for packages including 60 inch easels, but is wider than fixture 502 so that fixture 504 can accommodate a package including twenty 60 inch easels. Other examples, such as fixture 506 are sized for packages including ten 48 inch easels, while fixture 508 is sized for packages including twenty 54 inch easels. Easel packaging fixture 150 may be sized for other packages of any desired sizes and quantity of easels as needed.

Figure 6:
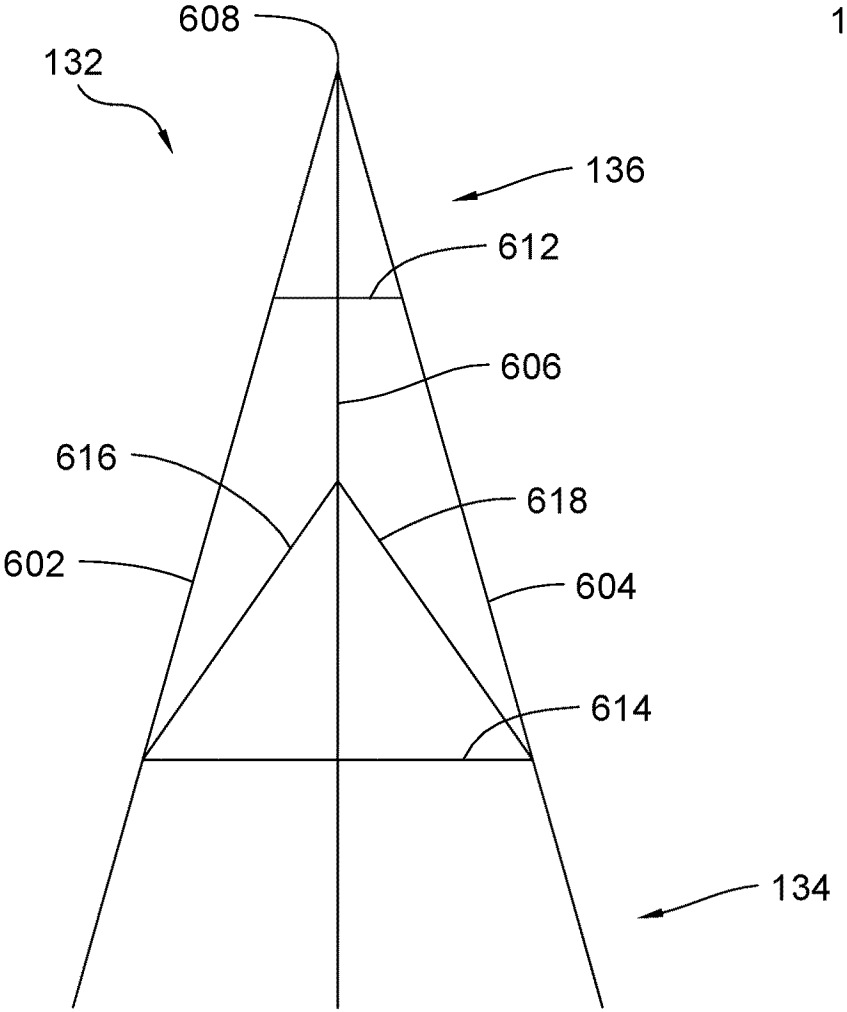

An embodiment of an easel 132 is illustrated in FIG. 6. Easel 132 is formed from three legs 602, 604, 606 that are joined at a common joint 608 in the upper portion 136 of easel 132. From common joint 608, legs 602, 604, 606 diverge from each other toward the lower portion 134 of easel 132. Each of the legs 602, 604, 606 is interconnected with the other legs by a series of struts. Strut 612 and strut 614 extend between legs 602 and 604. Strut 616 extends from leg 606 to strut 614 at a point near leg 602. Strut 618 extends from leg 606 to strut 614 at a point near leg 604.

Legs 602, 604, 606 are connected to allow easel 132 to be expanded into a use configuration. In the use configuration, leg 606 is hingedly displaced from the plane formed by legs 602 and 604 so that easel 132 forms a pyramid shape. When easel 132 is not in use, easel 132 may be moved into a storage configuration so that easel 132 takes up less space. In the storage configuration, leg 606 is pivoted toward legs 602, 604, so that each of the legs 602, 604, 606 is generally arranged within the same plane so that easel 132 forms a more two-dimensional, triangular shape, as shown in FIG. 6.

Figure 7:
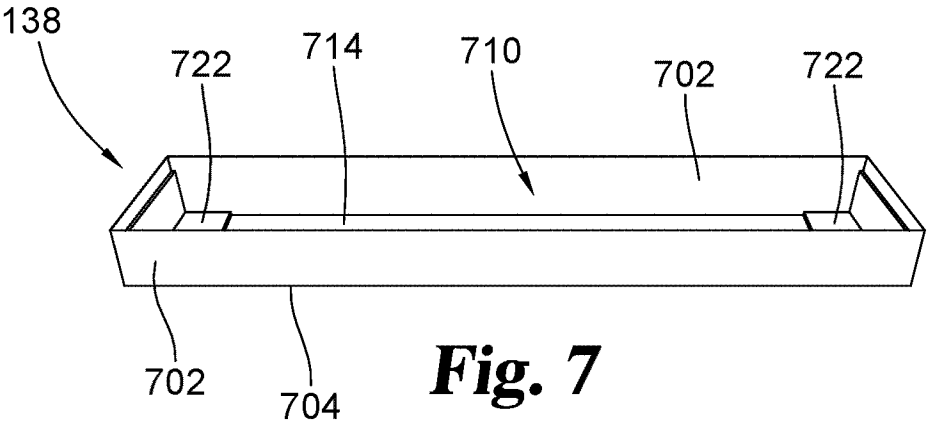
FIG. 7 is a front perspective view of a bottom cap of an easel bundle of the packaging system shown in FIG. 1.

When in the storage configuration, the lower portion 134 of easel 132 is able to be fit within a bottom cap 138. An embodiment of the bottom cap 138 is shown in FIG. 7. Bottom cap 138 includes bottom cap side walls 702 that extend from a bottom cap base 704. The side walls 702 define a bottom cap recess 710 which is bordered by an inner surface 714 defined by the bottom cap base 704.

When easel 132 is in the storage configuration, the legs 602, 604, 606 of easel 132 may be inserted into bottom cap recess 710, so that bottom cap 138 covers the lower portion 134 of easel 132. When the lower portion of 132 of easel 132 is inserted into bottom cap recess 710, at least one of the legs 602, 604, 606 is in contact with the inner surface 714 of the bottom cap base 704. In order to prevent destruction of bottom cap 138 due to contact with the legs of easel 132, reinforcement portions 722 may be present or inserted into bottom cap 138 to provide additional support for bottom cap 138 at the surfaces where legs 602, 604, and/or 606 contact bottom cap 138.

In FIG. 7, reinforcement portions 722 are found at the corners of bottom cap 138 where leg 602 and leg 604 contact bottom cap 138 when legs 602, 604 are inserted into bottom cap recess 710. While not shown, an additional reinforcement portion 722 may also be included near the center of inner surface 714 where leg 606 may contact bottom cap base 704. In other embodiments, reinforcement portions 722 may be found at different locations on bottom cap 138 or bottom cap 138 may include either more or fewer reinforcement portions 722.

Bottom cap 138 may be made from a lightweight, durable material such as cardboard. However, in some embodiments, bottom cap 138 may be made from other suitable materials such as wood, plastic, metal or the like. Reinforcement portions 722 of bottom cap 138 may be made from the same material as side walls 702 and bottom cap base 704 or may be made from a different material if desired, including rubber or a similar show absorbing and/or resilient material.

In the embodiment shown in FIG. 7, bottom cap 138 is one continuous piece that covers each of the legs 602, 604 and 606. In other embodiments multiple bottom caps 138 may be used. For example, easel bundle 130 may include three bottom caps 138, where the end of a single leg 602, 604, or 606 is inserted into its own bottom cap 138.

Figure 8:
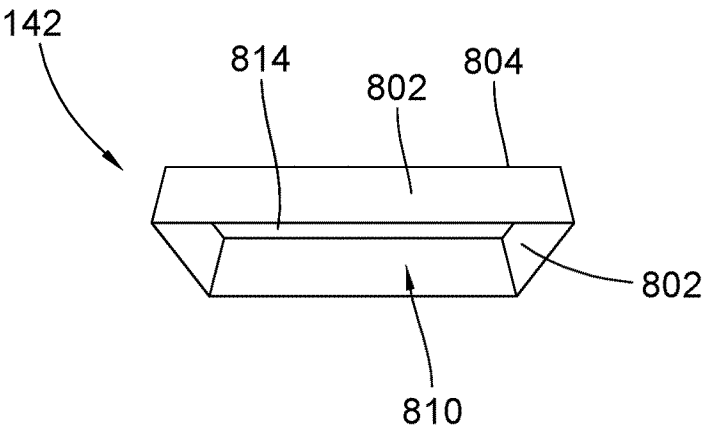
FIG. 8 is a front perspective view of a top cap of an easel bundle of the packaging system shown in FIG. 1.

FIG. 8 illustrates a top cap 142. Top cap 142 includes top cap side walls 802 that extend vertically from a top cap base 804. The side walls 802 define a top cap recess 810 which terminates at an inner surface 814 defined by the top cap base 804. Top cap 142 is configured to cover at least a part of the upper portion 136 of easel 132 when easel 132 is arranged in the storage configuration. The common joint 608 of easel 132 is inserted into top cap recess 810 so that common joint 608 comes into contact with inner surface 814. In some embodiments, much like that described with respect to bottom cap 138, top cap 142 may include reinforcement to prevent common joint 608 from tearing or damaging top cap 142.

Typically, although not required, top cap 142 has a length that is shorter than the length of bottom cap 138, for example, as shown in FIG. 1. Since top cap 142 only covers the common joint 608 of easel 132 while the bottom cap 138 covers the ends of each of the legs 602, 604, 606, the top cap 142 does not require a length as long as the length of bottom cap 138. The smaller top cap 142 reduces the size of easel bundle 130, making easel bundle 130 easier to carry and handle and also reduces packaging and shipping costs.

Top cap 142 may be made from a lightweight, durable material such as cardboard. However, in some embodiments, top cap 142 may be made from other suitable materials such as wood, plastic, metal or the like. Reinforcement portions of top cap 142 may be made from the same material as top cap 142 or may be made from a different material if desired.

Figure 9:
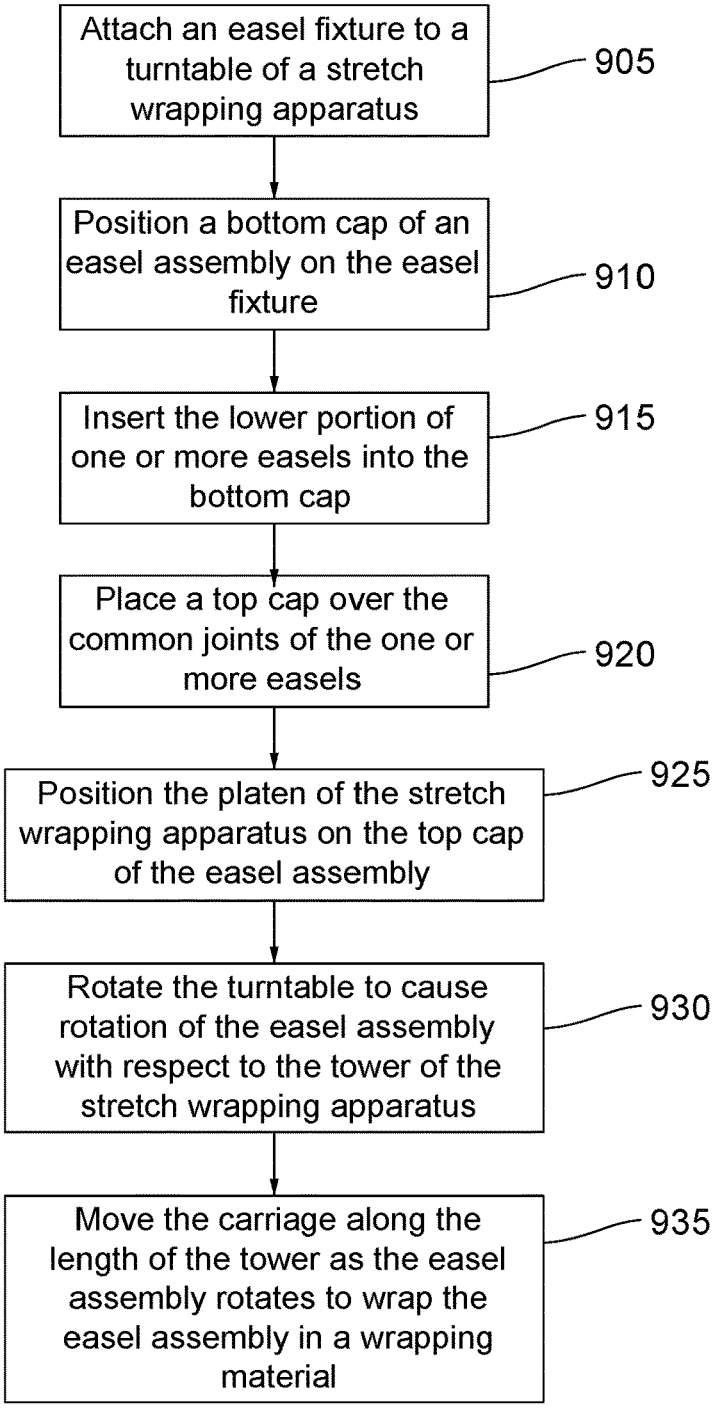
FIG. 9 is a flowchart illustrating a method of packaging easels.

A flowchart 900 illustrating a method of packaging easels is show in FIG. 9. In a first step 905, an easel packaging fixture 150 is selected and attached to a turntable 160 of a stretch wrapping apparatus 110. The easel packaging fixture 150 may correspond to the size of the easel packaging fixture 150 and to the number and size of the easels included in the easel bundle 130. The easel packaging fixture 150 may also be removably attached to turntable 160 to allow different sized easel packaging fixtures 150 to be used on turntable 160. In a second step 910, a bottom cap 138 of an easel bundle 130 is positioned on the easel packaging fixture 150. The bottom cap 138 also corresponds to the size of the easel packaging fixture 150 and to the number and size of the easels included in the easel bundle 130.

In a third step 915, the lower portion 134 of the one or more easels 132 included in easel bundle 130 are inserted into a bottom cap recess 710 defined in bottom cap 138. The easel bundle 130 is arranged so that at least a portion of each leg 602, 604, 606 of the one or more easels 132 is within bottom cap recess 710. In a fourth step 920, a top cap 142 is placed over the common joint 608 of the one or more easels 132 in easel bundle 130. The common joints 608 are inserted into a top cap recess 810 defined in top cap 14. In a fifth step 925, the platen 126 of stretch wrapping apparatus 110 is positioned on the top cap 142 of the easel bundle 130 locking the components into place.

Figure 10:
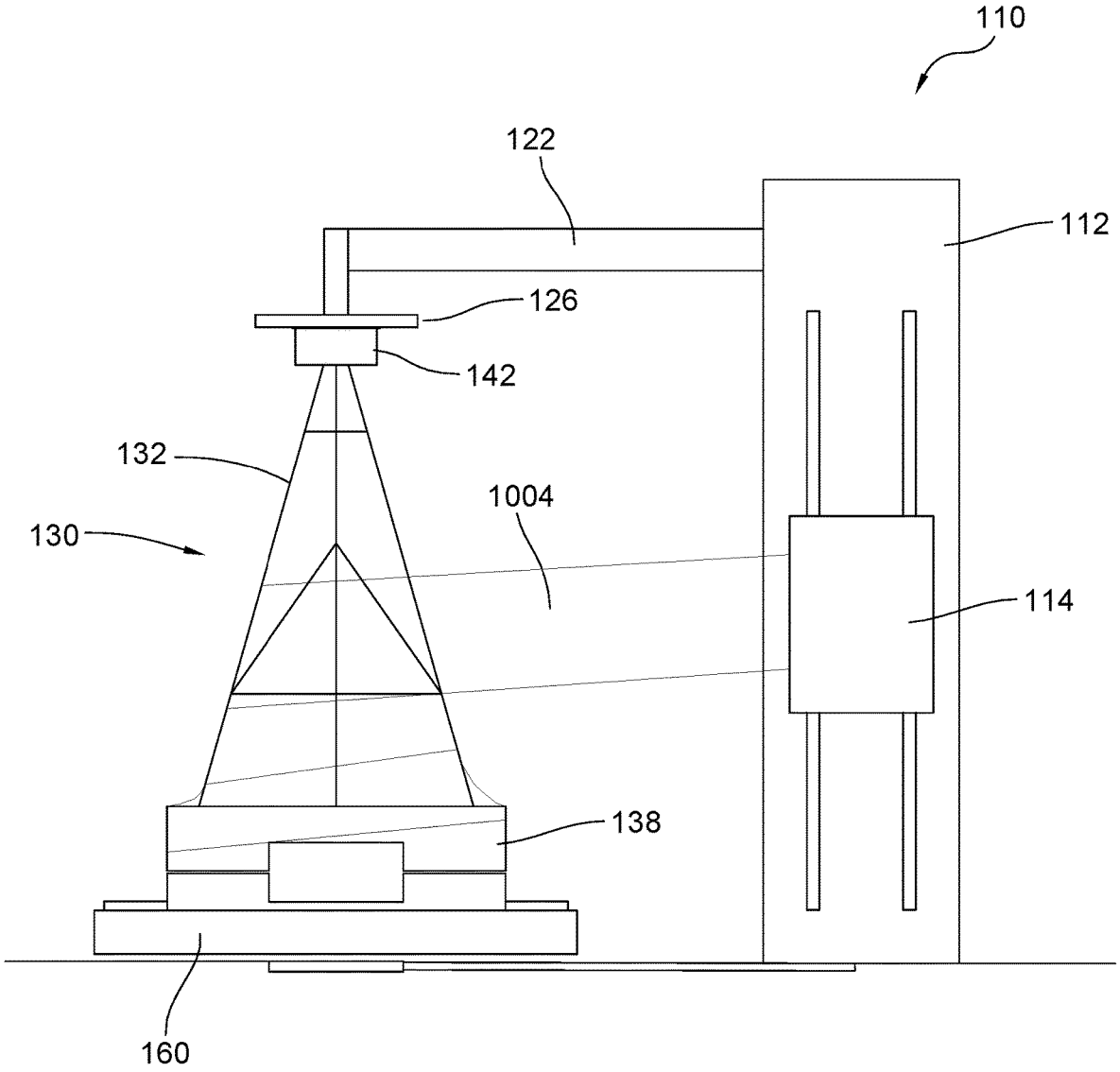
FIG. 10 is a front elevational view of the packaging system of FIG. 1 in operation as the easel bundle is being wrapped by a wrapping material.

In a sixth step 930, the turntable 160 is rotated, causing rotation of the attached easel packaging fixture 150 and the easel bundle 130 positioned on the easel packaging fixture 150 with respect to the tower 112 of the stretch wrapping apparatus 110. A carriage 114 movably attached to the tower 112 of the stretch wrapping apparatus 110 includes a wrapping material 1004 (see FIG. 10), such as a length of stretch wrap. One end of the stretch wrap is placed into contact with and may be secured to the easel bundle 130. In a seventh step 935, as the easel bundle 130 rotates, the carriage 114 travels along the length of the tower so that the length of wrapping material wraps around the easel bundle 130. As shown in FIG. 10, the wrapping material may directly contact the easel 132 of easel bundle 130. The wrapping material may also around the entirety or a portion of the bottom cap 138 and/or the top cap 142.

In some embodiments, the carriage 114 begins at the height of the bottom cap and moves along tower 112 until carriage 114 reaches the height of platen 126. Once the height of platen 126 is reached, the stretch wrap may be cut or removed from carriage 114, or carriage 114 may slide in the opposite direction along tower 112 to apply another layer of stretch wrap to easel bundle 130. Carriage 114 may be moved along the length of tower 112 as many times as desired to provide additional layers of stretch wrap on easel bundle 130. Alternatively, the carriage 114 may be moved along various portions of the tower 112 until the desired wrapping is achieved. In one further form, more wrapping may be placed at the top and bottom of the easel bundle 130, or in other areas identified to warrant the same.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A method of packaging easels, the method comprising:

attaching an easel packaging fixture to a turntable of a stretch wrapping apparatus, wherein said stretch wrapping apparatus includes a tower and a carriage movable along said tower;

positioning an easel bundle on said easel packaging fixture, wherein said easel bundle includes one or more easels each having an upper width and a lower width, and wherein a lower portion of each of said one or more easels is inserted into a bottom cap, and an upper portion of each of said one or more easels is inserted into a top cap, wherein the bottom cap has a bottom cap width fitted to the lower width and the top cap has a top cap width fitted to the upper width, so that the top cap width is different than said bottom cap width;

rotating said turntable so that said easel packaging fixture and said easel bundle rotate with respect to said tower and said carriage of said stretch wrapping apparatus so that a wrapping material from said carriage wraps around said easel bundle; and moving said carriage along a length of said tower as said easel bundle rotates to wrap at least of portion of the length of said easel bundle from said lower portion to said upper portion with said wrapping material; wherein the wrapping material securely attaches the bottom cap and the top cap to the easel bundle for transportation.

2. The method of claim 1, further comprising:

positioning a platen of said stretch wrapping apparatus at a height so that said platen is in contact with said top cap of said easel bundle.

3. The method of claim 2, wherein said carriage moves along the length of said tower until the carriage reaches the height of said platen.

4. The method of claim 1, wherein said easel packaging fixture is selected from a group of easel packaging fixtures with varying widths and lengths, and wherein each of the easel packaging fixture s from said group of easel packaging fixtures corresponds to an easel bundle containing a predetermined quantity of easels each having a given size.

5. The method of claim 1, wherein said easel bundle includes at least two easels, and wherein each of said easels are oriented in the same direction so that said upper portion of each easel is aligned with said upper portions of the other easels and the lower portion of each easel is aligned with said lower portions of the other easels.

6. The method of claim 1, wherein said bottom cap of said easel bundle is in contact with said easel packaging fixture when said easel bundle is positioned on said easel packaging fixture.

7. The method of claim 1, wherein said easel packaging fixture includes attachment flanges defining attachment openings and wherein said turntable includes fixture attachment posts and wherein said easel packaging fixture attaches to said turntable by inserting said fixture attachment posts through said attachment openings.

8. The method of claim 1, wherein said wrapping material wraps around said bottom cap.

9. The method of claim 8, wherein said wrapping material wraps around said top cap.

10. The method of claim 1, wherein said easel bundle has a triangular shape after being wrapped by the wrapping material.

11. The method of claim 1, wherein said carriage travels along the length of said tower at least twice.

12. The method of claim 1, wherein said easel packaging fixture is removably attached to said turntable.

13. The method of packaging easels of claim 1, wherein said easel packaging fixture is removably attached to the turntable of said stretch wrapping apparatus by mating one or more attachment openings on the easel packaging fixture to one or more corresponding attachment posts on turntable.

14. A method of packaging easels, the method comprising:

selecting an easel packaging fixture from a group of easel packaging fixtures with varying widths and lengths, wherein each of the easel packaging fixtures from said group of easel packaging fixtures corresponds to a different sized easel bundle;

attaching said easel packaging fixture to a turntable of a stretch wrapping apparatus, wherein said turntable is rotatably attached to a pulley of said stretch wrapping apparatus, and wherein said stretch wrapping apparatus includes a tower and a carriage movable along said tower;

positioning an easel bundle on said easel packaging fixture, wherein said easel bundle includes one or more easels each having an upper width and a lower width, and wherein a lower portion of each of said one or more easels is inserted into a bottom cap, and an upper portion of each of said one or more easels is inserted into a top cap, wherein the bottom cap has a bottom cap width fitted to the lower width and the top cap has a top cap width fitted to the upper width, so that the top cap width is different than said bottom cap width;

positioning a platen of said stretch wrapping apparatus so that said platen is in contact with said top cap of said easel bundle;

rotating said turntable so that said easel packaging fixture and said easel bundle rotate with respect to said tower and said carriage of said stretch wrapping apparatus so that a wrapping material from said carriage wraps around said easel bundle; and moving said carriage along a length of said tower as said easel bundle rotates to wrap a length of said easel bundle, wherein the wrapping material securely attaches the bottom cap and the top cap to the easel bundle for transportation.

* * * * *